US007150421B2

(12) United States Patent
Blümel et al.

(10) Patent No.: US 7,150,421 B2
(45) Date of Patent: Dec. 19, 2006

(54) JET MILL

(75) Inventors: Siegfried Blümel, Ratigen (DE); Volker Jürgens, Kirchhundem (DE); Hans-Ulrich Schwanitz, Köln (DE); Siegfried Wensing, Leverkusen (DE)

(73) Assignee: Kronos International (DE)

( * ) Notice: Subject to any disclaimer, the term of this patent is extended or adjusted under 35 U.S.C. 154(b) by 17 days.

(21) Appl. No.: 10/706,868

(22) Filed: Nov. 12, 2003

(65) Prior Publication Data

US 2004/0200913 A1 Oct. 14, 2004

(30) Foreign Application Priority Data

Nov. 12, 2002 (DE) ..... 102 52 441

(51) Int. Cl.
*B02C 19/06* (2006.01)

(52) U.S. Cl. ..... 241/39; 241/5; 241/38; 241/40

(58) Field of Classification Search ..... 241/5, 241/39, 40, 38
See application file for complete search history.

(56) References Cited

U.S. PATENT DOCUMENTS

| | | | | |
|---|---|---|---|---|
| 4,056,233 | A * | 11/1977 | Fay | 241/39 |
| 4,248,387 | A * | 2/1981 | Andrews | 241/5 |
| 4,502,641 | A * | 3/1985 | Coombe | 241/5 |
| 5,855,326 | A * | 1/1999 | Beliavsky | 241/5 |
| 6,196,482 | B1 * | 3/2001 | Goto | 241/39 |
| 6,726,133 | B1 * | 4/2004 | Hahn et al. | 241/1 |

FOREIGN PATENT DOCUMENTS

| | | | |
|---|---|---|---|
| DE | 7617063 | U1 | 9/1981 |
| DE | 29909743 | U1 | 10/1999 |

* cited by examiner

*Primary Examiner*—Derris H. Banks
*Assistant Examiner*—Jason Y. Pahng
(74) *Attorney, Agent, or Firm*—Rodney T. Hodgson

(57) ABSTRACT

The invention relates to a jet mill of modular design for the comminution of powdery materials. An inner pulverizing casing made entirely of wear-resistant material is freely mounted in an outer casing pressure vessel.

22 Claims, 3 Drawing Sheets

JET MILL

CROSS REFERENCE TO RELATED APPLICATIONS

This application claims priority pursuant to Title 35, United States Code, Section 119(a)–(d) or (f), or 365(b) to the German Application Number 102 52 441.6 filed Nov. 12, 2002, by the same inventors. The above named application is hereby incorporated herein by reference in its entirety including incorporated material.

FIELD OF THE INVENTION

The field of the invention is the field of pulverizing or disagglomeration of solid particles. The invention relates to a jet mill with improved wear protection.

BACKGROUND OF THE INVENTION

Jet mills as such are known and are used for the pulverization or disagglomeration of solid particles. A number of older designs are described in detail in U.S. Pat. No. 2,032,827. They customarily comprise a flat, cylindrical pulverizing chamber, in which an inwardly directed circular or spiral flow of a gas or a gaseous fluid transports the particles to be pulverized. Particle comminution or pulverization is essentially achieved by the particles colliding with each other. The energy required for comminution is input via the gaseous medium (propellant), which, in many common configurations, is blown into the pulverizing chamber tangentially through jet nozzles distributed around the circumference, thereby generating and maintaining a vortex. The particles to be pulverized are fed into the pulverizing chamber via a separate feed line. The mills can be installed both horizontally and vertically. The propellant most commonly used is compressed air or steam.

The known jet mills, according to DE 76 17 063 U1, for example, are essentially constructed in such a way that only an inner steel ring is located inside a closed steel casing, comprising a bottom, an outer wall and a cover. The actual pulverizing chamber is located inside the steel ring and is bordered by the steel ring and the corresponding surfaces of the bottom and cover. The propellant is fed into the annular space between the outer casing wall and the inner steel ring, and passed via several nozzles through the inner steel ring into the pulverizing chamber.

OBJECTS OF THE INVENTION

It is an object of the invention to produce a jet mill with improved wear resistance. It is an object of the invention to produce a jet mill having simpler and easier assembly protocols. It is an object of the invention to produce a jet mill having less cost. It is an object of the invention to produce a jet mill which is less costly to replace parts. It is an object of the invention to produce a jet mill which may have jet configuration changed rapidly and easily. It is an object of the invention to produce a jet mill for the comminution of powdery materials that is wear-resistant and, moreover, largely resistant to pressure surges and insensitive to thermal shocks. It is an object of the invention to produce a jet mill with improved grinding quality.

SUMMARY OF THE INVENTION

The jet mill consists of a pressure-resistant pulverizing casing made entirely of wear-resistant material mounted entirely within an outer a pressurized outer casing which is made from a strong and tough material like steel.

DETAILED DESCRIPTION OF THE INVENTION

Figure 1:
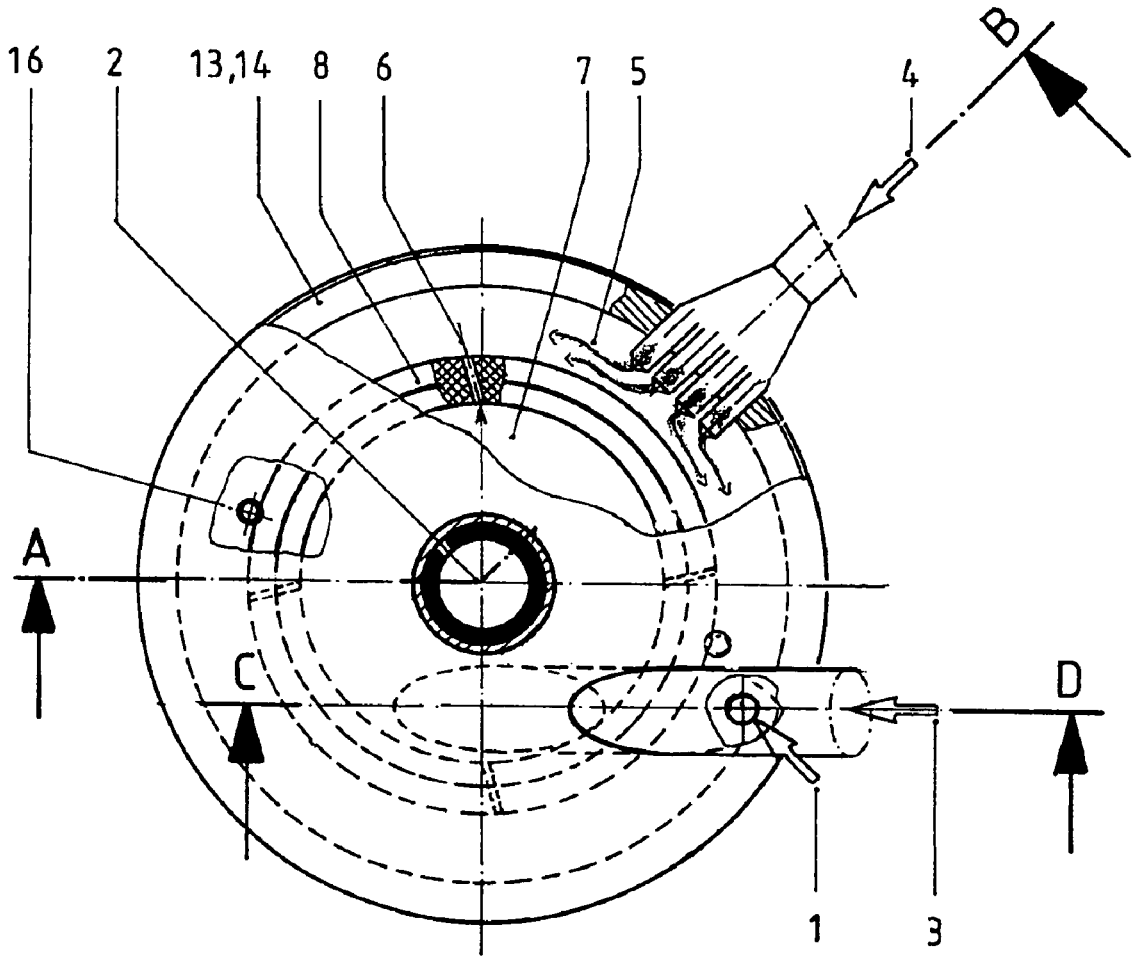
FIG. 1 shows a top view of the assembled invention.

Depending on the nature of the material to be comminuted, abrasion causes wear on the inside of the mill, thus increasing the maintenance effort required. The grinding quality obtained can change as a result of the wear, and the product is contaminated by abraded material. For this reason, the inner surface of the pulverizing chamber is customarily protected against abrasion by means of a hard, abrasion resistant or wear-resistant lining. A suitable, wear-resistant material is selected in accordance with the intended application, such as hard materials such as hard metal, aluminum oxide, silicon carbide, boron carbide, or titanium nitride, or also soft materials such as Teflon, nylon or polyurethane—(as in GB 1,222,25. The lining and the mill casing are customarily joined by build-up welding of hard metal, for example, or by some other method of non-positive connection, such as bolting, bonding or spot-welding.

It is known that, during build-up welding of hard metal on a steel base plate, for example, thermal stresses and deformations occur in the base plate. The hard-metal surface produced is irregular and cannot be manufactured reproducibly, particularly as regards the surface finish.

To repair or replace the lining, either the worn hard-metal coating has to be repaired, or the coating first has to be removed before a new build-up weld is applied. In either case, internal stresses and deformations occur, meaning that is it virtually impossible to reconstruct the exact mill geometry or surface finish. Repairs are generally expensive and time-consuming.

Jet mills with renewable or replaceable linings are known from the literature, e.g. from U.S. Pat. No. 2,032,827, GB 636,503 and GB 1,222,257. A wear-resistant lining in the form of plates is, for example, described in U.S. Pat. No. 2,690,880. The annular pulverizing chamber wall of this jet mill is lined with individual plates that can consist of a wear-resistant alloy and are bolted to the casing wall. DE-GM 7300113 discloses a vertical jet mill, the inside of which is completely lined with a plurality of flat plates made of wear-resistant material. The plates are preferably made of boron carbide (BC) or silicon carbide (SiC) and bonded or welded to the mill casing over the entire surface. DE 299 09 743 U1 describes a horizontally installed jet mill of modular design, in which only certain areas are protected by a wear-resistant lining and in which some of the propellant is introduced into the pulverizing chamber through a perforated base.

A further common feature of all the designs mentioned is that the jet nozzles, which are located in the annular pulverizing chamber wall and through which the high-pressure propellant is introduced, pass through the two-layer structure of the pulverizing chamber wall (comprising the steel ring and the inner lining) and must themselves be of wear-resistant design, e.g. made of ceramic material. Moreover, the hole through which the nozzle passes must be of pressure-tight design. Furthermore, whenever the pulverizing chamber lining is repaired, the nozzles have to be removed and subsequently re-installed.

In addition to the abrasive stress on the inside of the mill, a significant thermal stress occurs upon starting the mill when using high-pressure steam at temperatures of up to 350° C.—for instance when pulverizing titanium dioxide pigments. The wear-resistant materials preferably used, such as carbides, nitrides or hard metal, are generally known to be very brittle. Consequently, the wear protection material can easily fracture owing to the different thermal expansion properties of the various materials used in the casing and the lining.

Moreover, because of the different moduli of elasticity of the substrate and coating materials, there is a risk of the coated parts easily cracking when exposed to stress, thus resulting in spalling of the wearing layer.

The object of the invention is to provide a jet mill for the comminution of powdery materials that is wear-resistant and, moreover, largely resistant to pressure surges and insensitive to thermal shocks, requires less repair effort and offers improved grinding quality.

The object is solved by a jet mill consisting of a pressurized outer casing, made from a strond and tough material like steel and a pressure-resistant pulverizing casing made entirely of wear-resistant material mounted entirely within the outer casing.

Other advantageous embodiments are described in the dependent claims.

The subject matter of the invention is a jet mill offering, among other things, the following advantages compared to the known technical solutions:

A substantially longer service life, shorter repair times, simple cleaning, stress-free assembly, achievement of reproducible grinding quality following repairs due to the restorable mill geometry, use of different wear-resistant materials—and also combinations thereof—adapted to suit the requirements of the material to be pulverized.

The jet mill according to the invention is constructed of an outer casing and a pulverizing casing freely mounted within the outer casing. The outer casing and the pulverizing casing each constitute a separate and—apart from the feed and discharge lines—self-contained casing. The term "freely mounted" means that the pulverizing casing and the outer casing are not permanently connected to each other.

The outer casing is made in the known manner out of steel or other tough and strong material such as fiber glass or other composite material. In contrast, the pulverizing casing consists entirely of wear-resistant material and is characterized by a special design.

It is emphasized in DE 299 09 743 U1 that a mill consisting entirely of silicon carbide, for example, is only suitable for limited use because of its brittleness. This is why the casing itself consists of two layers in the known jet mills: first, a substrate material, generally steel, and, second, a lining of wear-resistant material applied to the inside of the substrate material.

In contrast, the pulverizing casing according to the invention is made entirely of a wear-resistant material. The materials open to consideration include, for example, carbides, such as tungsten carbide (e.g. WC—Co alloy known as Widia®), silicon carbide, boron carbide or other suitable carbides, as well as nitrides, borides or other ceramics or hard metal. Furthermore, the wear-resistant materials can also be used in combination with each other.

This design is possible because the pulverizing casing is mounted in the outer casing in self-supporting fashion, without permanent connections and without stress.

The pulverizing casing consists of four parts in the most preferred embodiment of the invention. In a horizontally installed mill, these are a bottom, a cylindrical side wall, a top cover with an integrally molded product discharge nozzle, and a particle feed nozzle. The cover bears not only the product discharge nozzle, but also the opening for feeding the particles to be pulverized. The bottom, the side wall, the cover and the particle feed nozzle contact each other in non-positive manner with optional special seals. The entire, multi-part pulverizing casing is located within the outer casing in stress-free fashion. The mill can also be correspondingly installed vertically.

The space between the outer casing and the cylindrical side wall of the pulverizing casing serves as an annular high-pressure propellant duct. The propellant is passed through one or more nozzles, initially into the annular propellant duct between the outer and inner casings and, from there, via simple holes drilled through the cylindrical side wall or ring of the pulverizing casing (pulverizing chamber wall) into the interior of the pulverizing casing, (the pulverizing chamber). It is not necessary to line the drilled holes with special wear protection, or to take special measures for sealing—as necessary with known mills having special nozzles.

Connection of the parts of the outer casing and the pulverizing casing to form a pressure-resistant mill is accomplished in the most preferred embodiment of the invention by means of bolts or clamps on the outer circumference of the outer casing. A bolted or clamped connection has the advantage that the mill can very easily and very rapidly be opened and subsequently closed again for cleaning or maintenance work. The entire the pulverizing casing, or the individual parts of the pulverizing casing are simply lifted out and/or inserted. As a result, the propellant duct is also directly accessible and can be cleaned without difficulty.

The individual parts of the wear-resistant pulverizing casing—bottom, side wall, cover—can also be further divided into segments if manufacturing from sintered material in a single piece gives rise to problems owing to the excessive size of the parts. The segments are joined in such a way that the pulverizing casing is substantially airtight and positioned in the outer casing without stress. Slight leaks from the interior of the outer casing to the interior of the interior casing where the bottom, side walls, and top of the outer casing join may be tolerated if they do interfere with the operation of the mill, (since the propellant flow through those leaks is a very small fraction of the propellant flow through the propellant inlet holes) and if the propellant can not flow from the interior of the milling chamber back into the propellant duct carrying powder into the duct. In this case, there will be danger of clogging and the flow within the milling case will be disturbed The propellant is most preferably fed into the pulverizing chamber through simple drilled holes. In a preferred embodiment, nozzles are installed and more specifically Laval nozzles are installed. The nozzles are installed using known methods; for example, with the help of special solder, bushings with threaded bores can also be inserted to accommodate the nozzles.

The propellant used is most preferably superheated steam or compressed air. Other gases or fluids such as water are preferably used. The pressure is most preferably a pressure of up to approximately 35 bar and the temperature is preferably from room temperature to 350° C. The exact pressure and temperature are adapted to suit the respective particles to be pulverized and the required fineness of grind and finish required on the finished particles. Such pressures and temperatures and other conditions of gas flow rate, nozzle size etc will be found by ordinary experimentation by one of skill in the art using the present description. Pressures higher than 35 bar will of course require thicker outer casing walls to contain the pressure, and higher temperatures will require material resistant to the pressure used at the temperatures used.

When the mill is operated at elevated temperatures, excess pressure builds up at the cover and bottom between the outer casing and the pulverizing casing during heating. This pressure is relieved by means of optional venting bores in the bottom and the cover of the outer casing.

The surface of the interior of the pulverizing casing can be of any design. As a general rule, it is smooth. Under certain grinding conditions, it is advantageous for the grinding quality to design the surface on the bottom plate or on the other interior surfaces and in the particle feed nozzle with a texture, i.e. with furrows, grooves, ripples, nibs or the like. It has been found when pulverizing titanium dioxide pigments, for example, that a textured pulverizing chamber surface of this kind can be used to influence the optical properties of the pigment, such as the gloss.

The jet mill is advantageously used for pulverizing titanium dioxide pigment particles, superheated steam being used as the propellant. Regardless of this, the mill is equally suitable for pulverizing other materials, such as pigments and dyes in general, or other materials, such as inorganic and metal oxides, toners, mineral extenders and fillers (carbonate, chalk, talcum, etc.), detergents, pharmaceuticals, foods, cosmetics, fertilizers, herbicides, pesticides, insecticides, fungicides, sewage sludge, etc.

An advantageous embodiment of the invention is described below on the basis of FIGS. 1 to 3 by way of example:

FIG. 1 shows a top view of the jet mill according to the invention, with particle feed (1) and injector gas feed (3) into the pulverizing chamber (7), as well as the centrally located product discharge (2). The propellant feed (4) is located at the edge, passing through the outer casing (13, 14) into the propellant duct (5). The side wall of the pulverizing casing, the pulverizing casing ring (8), is provided with drilled holes (6) for feeding the propellant into the pulverizing chamber (7).

Figure 2B:
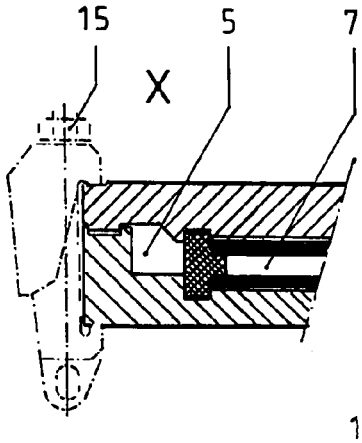
FIG. 2*b* shows a side view of a portion of the invention along section AB with inner and outer casings clamped in operating positions.
Figure 2A:
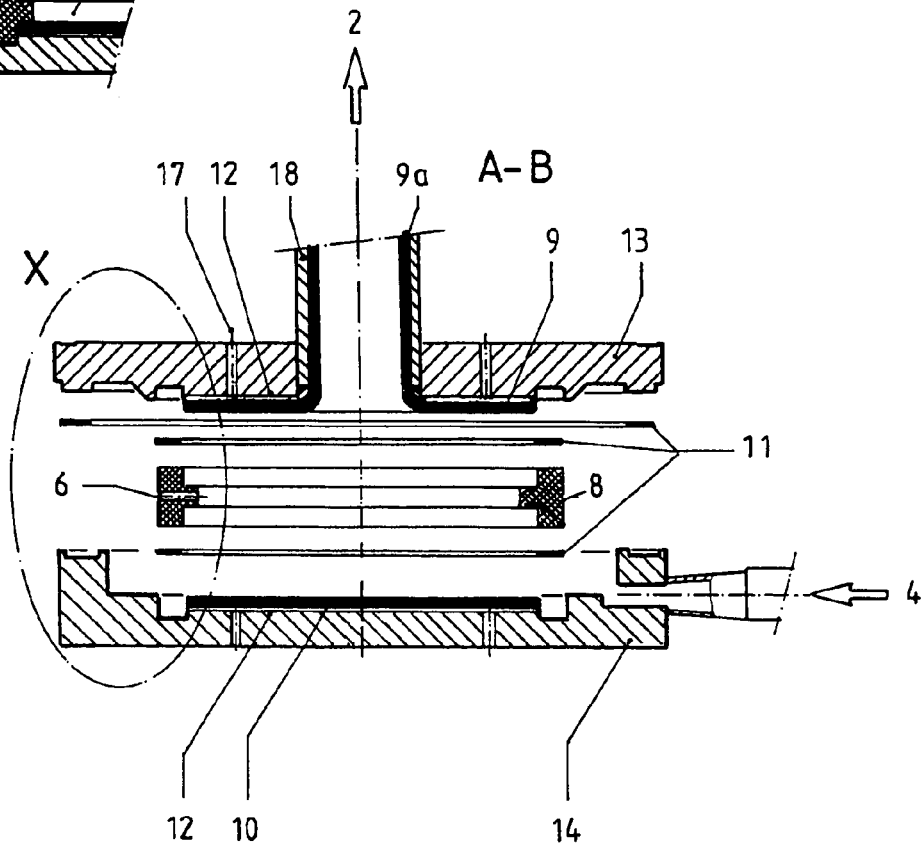
FIG. 2*a* shows a side view of the invention along section AB expanded to show inner and outer casings separated.
Figure 3B:
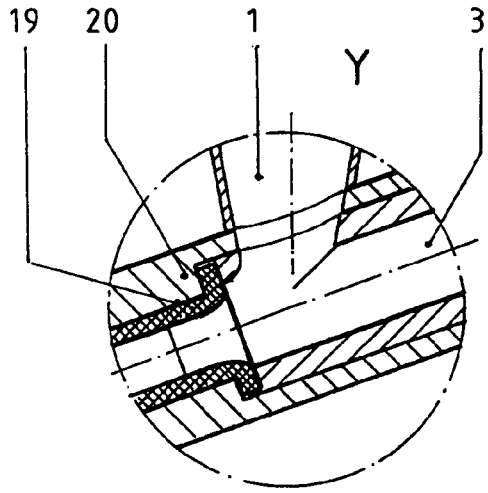
FIG. 3*b* shows an expanded side view of the invention along section CD.
Figure 3A:
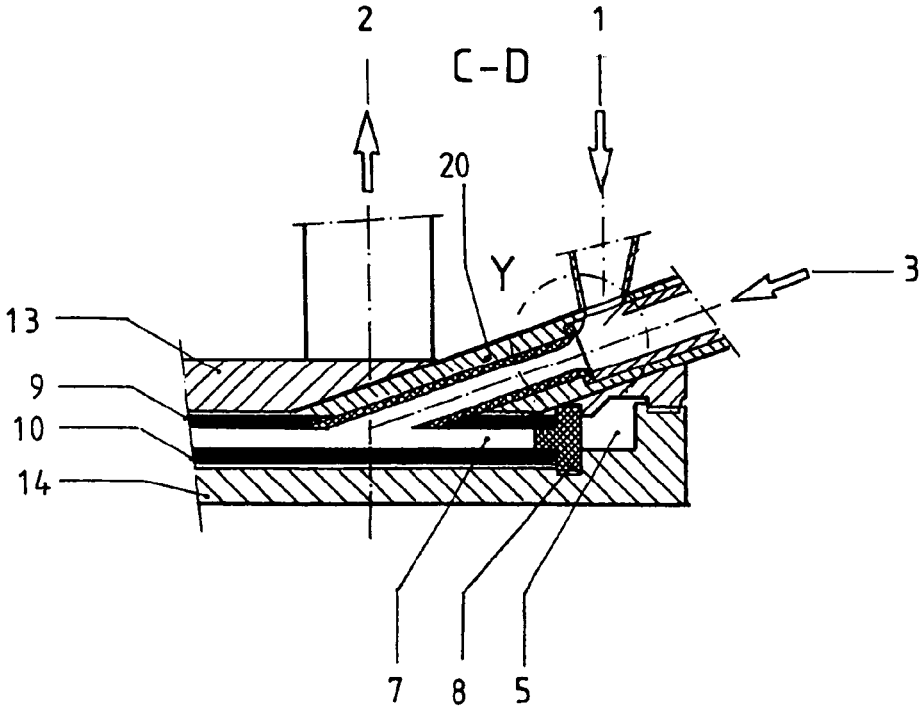
FIG. 3*a* shows a side view of the invention along section CD.

FIG. 2*a* illustrates section AB in the form of an exploded drawing for better comprehension. FIG. 2*b* shows detail X from FIG. 2*a*. The outer steel casing is designed as a shell (14) and a cover (13) with integrally molded product discharge nozzle (18) and particle feed/injector gas feed nozzle ((20), shown in FIG. 3*a*). The pulverizing casing located therein, made of wear-resistant material, consists of a bottom (10), a ring (8) and a cover (9), again with integrally molded product discharge nozzle (9*a*), as well as the particle feed nozzle, which is illustrated in FIGS. 3*a/b*. The propellant duct (5) is located between the outer shell (14) and the outer cover (13), and the pulverizing casing ring (8). Located inside the pulverizing casing is the pulverizing chamber (7). During assembly the pulverizing casing cover (9) positioned on the product discharge nozzle (18) with optional locating screws.

Propellant feed (4) into the propellant duct (5) can take place via one or more feed nozzles. Propellant feed is preferably accomplished via several feed lines, in order to be able to feed the necessary quantity of gas into the propellant duct without disturbances and without any loss of pressure.

FIG. 1 shows how the pulverizing casing ring (8) is fixed in position relative to the pulverizing casing bottom (7) with the help of an optional locating pin (16) inserted loosely into a recess in the pulverizing casing ring (8) and the outer casing bottom (14). The outer casing cover (13) is preferably subsequently rotatable through up to 180° relative to the pulverizing chamber ring (8), without having to open the mill, so that that different geometrical arrangements of the particle feed in relation to the propellant feed into the pulverizing chamber can be set.

The number of drilled holes or nozzles (6) most preferably depends on the diameter of the pulverizing chamber. For example, 4 nozzles are used for a relatively small diameter of 200 mm, for instance, and 16 nozzles for larger diameters in the region of 1,000 mm. However, other combinations are also possible. The angle of the drilled holes (6) in the pulverizing chamber ring wall (8) is selected on the basis of the material to be pulverized and the required grinding quality. The person skilled in the art is familiar with the relationships between the angle of the nozzles or drilled holes, the number of nozzles, the propellant pressure, throughput, etc. and the fineness of grind for different products. Owing to the modular design of the overall mill, and particularly of the pulverizing casing, the number of drilled holes or nozzles and their angle can easily be changed by replacing the entire pulverizing casing ring or individual segments thereof.

The contact surfaces between the individual parts of the pulverizing casing (8, 9, 10) are smoothed to be self-sealing. The seal between the pulverizing casing ring (8) and the outer casing shell (14) and the outer casing cover (13) is optionally made with the help of a seal (11), such as a graphite seal. The surface tolerances of the outer casing and the pulverizing casing often differ by one to two orders of magnitude. For this reason, it is advantageous, but not necessary, to insert an equalizing foil (12) both between the pulverizing casing bottom (10) and the outer casing bottom (14) and between the pulverizing casing cover (9) and the outer casing cover (13) to establish a non-positive connection. The entire mill is preferably held together by screw clamps (15) on the outer circumference as shown in the diagram, or other convenient method of joining the top to the bottom of the outer casing such as bolts. In this way, both the pulverizing casing (8, 9, 10, 19) and the high-pressure propellant duct (5) are sealed in pressure-tight fashion.

Furthermore, the outer casing shell (14) and the outer casing cover (13) have optionally one or more venting bores (17), which release the excess pressure occurring between the outer casing and the pulverizing casing during heating, thus permitting stress-free operation.

FIG. 3*a* shows a side view of the particle feed along section CD. FIG. 3*b* illustrates detail Y from FIG. 3*a*. In the embodiment shown, the material (1) to be pulverized is fed via a hopper and introduced into the pulverizing chamber (7) at an angle with the help of the injector gas stream (3). The wear-resistant particle feed nozzle (19) is designed as a bushing, which is inserted loosely into the feed nozzle of the outer casing (20) and optionally positioned with a locating screw during the installation procedure. The jet mill according to the invention is insensitive to thermal shocks and very largely resistant to pressure surges.

Obviously, many modifications and variations of the present invention are possible in light of the above teachings. It is therefore to be understood that, within the scope of the appended claims, the invention may be practiced otherwise than as specifically described.

We claim:

1. An apparatus, comprising:

a jet mill for the comminuation of powdery materials, comprising;

a pressure resistant pancake shaped pulverizing inner casing, the inner casing having walls encasing a pancake shaped first cavity, the inside casing comprising a cylindrical wall and two flat, substantially parallel walls, the cylindrical wall, of the inner casing for resisting a high first pressure outside the inner casing when a low second pressure obtains within the inner casing, the inner casing, the cylindrical wall having at least one first inlet port drilled through the cylindrical wall at a non-perpendicular angle, the first inlet port acting as a nozzle for introducing a propellant fluid having the high first pressure outside the inner casing into the first cavity, the at least one inlet port for converting potential energy of the propellant fluid outside the inner casing to kinetic energy of a jet of propellant fluid inside the first cavity when a low second pressure obtains within the first cavity, the inner casing for being completely contained within a pancake shaped second cavity, the second cavity defined by walls of a pressure resistant outer casing, wherein the outer casing is resistant to a pressure difference between the high first pressure inside the second cavity and a low third pressure outside the outer casing, and wherein a pressurized duct is formed inside the second volume between the walls of the outer casing and the cylindrical wall of the inner casing, and wherein the pressurized duct has a significant volume compared to the volume of the first cavity, and wherein the pressurized duct is filled with propellant fluid having the first high pressure, and wherein the propellant fluid is fed from the pressurized duct through the at least one first inlet port into the first cavity, the inner casing having abrasion resistant inner surfaces, the inner casing having at least one second inlet port for introducing a powdery material through a port in a wall of the outer casing into the first cavity, the inner casing having at least one outlet port for extracting the comminuated powdery material from the first cavity through a port in a wall of the outer casing.

2. The apparatus of claim 1, further comprising the outer casing.

3. The apparatus of claim 2, wherein the outer casing operatively compresses the inner casing over at least one area, and wherein at least one vent is placed in the outer casing in the at least one area.

4. The apparatus of claim 3, wherein an equalizing film is inserted between the outer casing and the inner casing over the at least one area.

5. The apparatus of claim 2, wherein the inner casing comprises four parts.

6. The apparatus of claim 5, wherein each part of the inner casing is made of a single abrasion-resistant material.

7. The apparatus of claim 5, wherein parts of the inner casing are made from different abrasion-resistant materials.

8. The apparatus of claim 5, wherein the abrasion resistant inner surface is smooth.

9. The apparatus of claim 5, wherein the abrasion resistant inner surface is textured.

10. The apparatus of claim 1, wherein the abrasion resistant inner surfaces are selected from a group consisting of hard metals, carbides, borides, nitrides, and ceramic materials.

11. The apparatus of claim 10, wherein the inner casing comprises four parts.

12. The apparatus of claim 11, wherein each part of the inner casing is made of a single abrasion-resistant material.

13. The apparatus of claim 11, wherein parts of the inner casing are made from different abrasion-resistant materials.

14. The apparatus of claim 1, wherein the propellant fluid is air.

15. The apparatus of claim 1, wherein the propellant fluid is nitrogen.

16. The apparatus of claim 1, wherein the propellant fluid is steam.

17. The apparatus of claim 1, wherein the abrasion resistant inner surface is smooth.

18. The apparatus of claim 1, wherein the abrasion resistant inner surface is textured.

19. The apparatus of claim 1, wherein the inner casing comprises four parts.

20. The apparatus of claim 19, wherein each part of the inner casing is made of a single abrasion-resistant material.

21. The apparatus of claim 19, wherein parts of the inner casing are made from different abrasion-resistant materials.

22. The apparatus of claim 1, wherein the inner casing is completely assembled before introduction into the outer casing.

* * * * *